US005460240A

United States Patent [19]

Jones

[11] Patent Number: 5,460,240

[45] Date of Patent: Oct. 24, 1995

[54] STABILIZED LADDER AND PLATFORM

[75] Inventor: Cecil G. Jones, Gulfport, Miss.

[73] Assignee: Mississippi Power Company, Gulfport, Miss.

[21] Appl. No.: 135,354

[22] Filed: Oct. 13, 1993

[51] Int. Cl.[6] ..... E06C 7/48

[52] U.S. Cl. ..... 182/116; 182/206

[58] Field of Search ..... 182/187, 188, 182/116, 206, 93

[56] References Cited

U.S. PATENT DOCUMENTS

| | | | |
|---|---|---|---|
| 84,711 | 12/1868 | Rogers . | |
| 1,658,191 | 2/1928 | Gravning | 182/206 |
| 2,510,520 | 6/1950 | Remmele . | |
| 2,677,575 | 5/1954 | Phillips . | |
| 3,028,929 | 4/1962 | Chubbs . | |
| 3,336,999 | 8/1967 | McSwain | 182/206 X |
| 3,630,314 | 12/1971 | Bamburg . | |
| 3,695,659 | 10/1972 | Gionet et al. . | |
| 3,995,714 | 12/1976 | Brookes et al. | 182/206 X |
| 4,469,195 | 9/1984 | Sartain . | |
| 4,722,420 | 2/1988 | Arthurs et al. . | |
| 4,946,004 | 8/1990 | Henson . | |
| 5,009,283 | 4/1991 | Prejean | 182/187 X |
| 5,267,632 | 12/1993 | Mintz | 182/187 X |

FOREIGN PATENT DOCUMENTS

| | | | |
|---|---|---|---|
| 83685 | 10/1957 | Denmark | 182/206 |
| 239473 | 10/1911 | Germany | 182/187 |
| 903147 | 7/1949 | Germany . | |

*Primary Examiner*—Alvin C. Chin-Shue
*Attorney, Agent, or Firm*—R. Lewis Gable

[57] ABSTRACT

A ladder and platform assembly is described for stabily and releasably securing a ladder to a utility pole or the like. The ladder is attched at one end to a platform and includes a pair of generally parallel, spaced apart legs and a plurality of steps disposed between and interconnected between the legs. The platform includes a latch assembly for stabilizing the platform when the platform is disposed to rest against the pole, which has a given configuration. The platform has an opening of a configuration similar to the given configuration for receiving the pole. The latch assembly includes a latch pivotally mounted on the platform to move between a first, closed position wherein the latch retains the pole within the opening and a second, closed position wherein the latch permits the pole to be received within or removed from the opening. The latch has an extended portion. A spring is attached to the latch for normally biasing the latch to the second, open position. A self locking detent is disposed for engaging the extended position of the latch as it moves to the second, closed position and retaining the latch in a locked relationship therewith in the second, closed position. An actuable mechanisim is provided for releasing the detente from the locked relationship with the latch and permitting the latch to return to its first, open position under the influence of the biasing spring.

11 Claims, 3 Drawing Sheets

FIG. 2
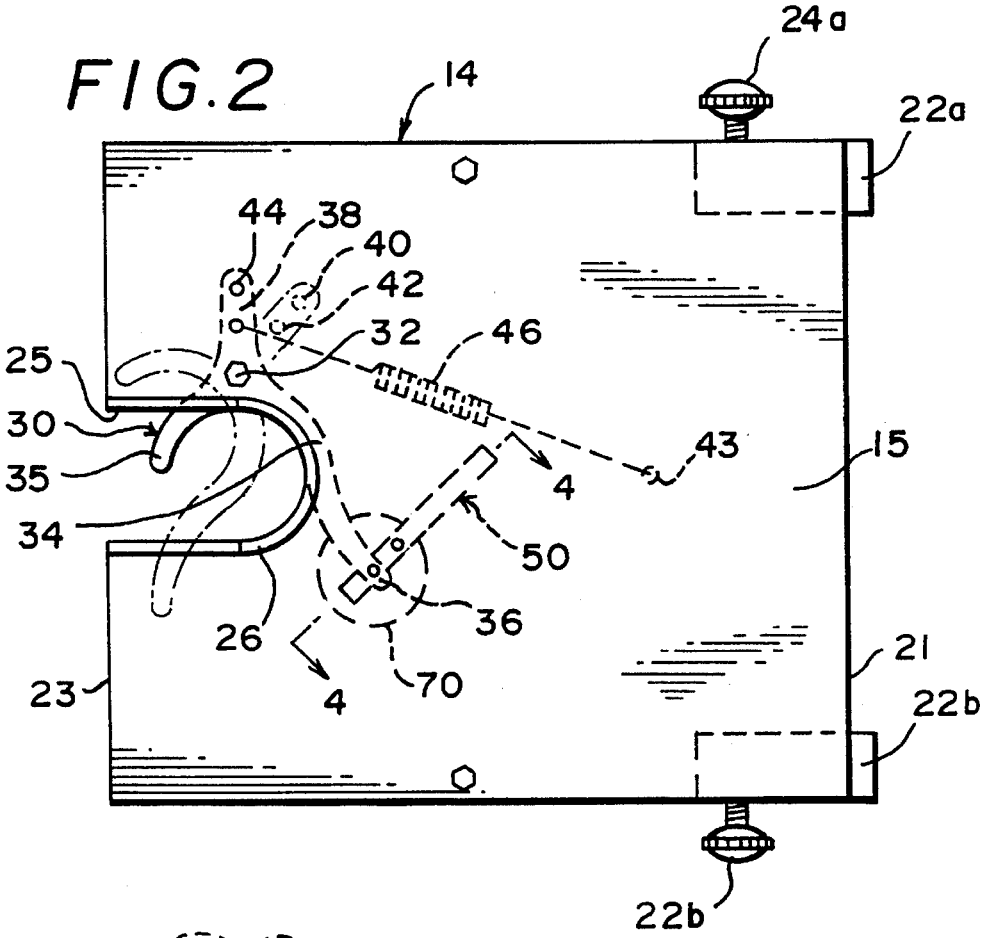
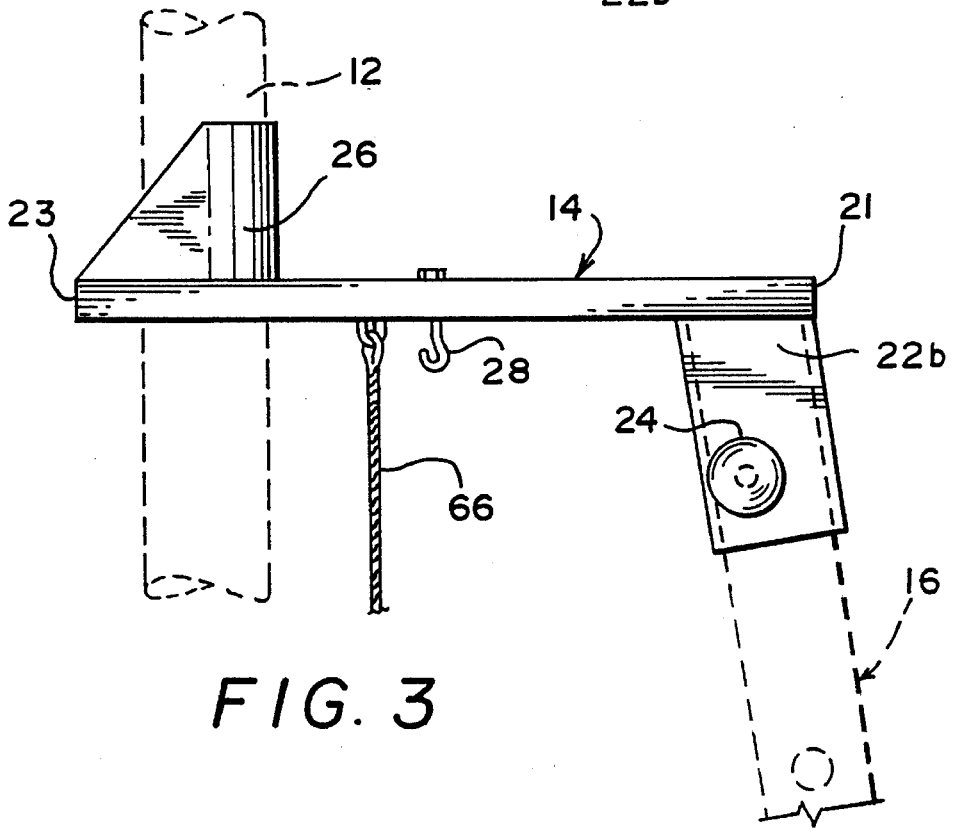
FIG. 3

STABILIZED LADDER AND PLATFORM

FIELD OF THE INVENTION

This invention relates to light weight, portable ladder and platform assemblies, which are used to climb objects such as utility poles, trees or the like. In particular, this invention relates to such assemblies, whose upper portions are stabilized with regard to the climbed object.

BACKGROUND OF THE INVENTION

Ladders are used for a wide variety of tasks that require ascending to a level normally out of reach when standing on the ground or floor. Most ladders used for ascending substantial heights, such as heights in excess of four to six feet, are designed to stand on the ground and lean against a flat surface, such as a roof or wall of a house. However, when such ladders are used to ascend trees, utility poles and other relatively small and/or non-flat surfaces, the ladder may tend to engage the non-flat surface along only one of the side rails of the ladder or along the top step thereof. As such, the ladder may tend to slide or twist as the climber ascends up the ladder or when the climber should lean outwardly to reach for something. Such ladders are typically stabilized by leaning the upper portion of the ladder against the object to be climbed and using a second person at the base to grasp and stabilize the upper portions of the ladder, while a first person climbs the ladder. The requirement for the second person adds a significant expense to the uses of existing ladders.

U.S. Pat. No. 4,946,004 of Henson discloses a ladder for gripping a pole and having a yoke member on which are pivotally mounted arcuate gripping arms about pivot pins. Each arm has an inner arm portion and is biased "open" by a spring. Engagement of the arm portions by the pole causes the arms to rotate to a point where the spring is disposed over the pivot pin and biases the arms to a closed position. No catch mechanism other than the spring is provided by Henson.

German Patent No. 903,147 shows a ladder mounted pole gripping device including jaws normally biased open by respective springs, and closed by a linkage, which is tied to a cord. The cord may be wound onto a reel disposed at the bottom of the ladder to pull the jaws to their closed positions. A detente engages the reel to prevent the reel from accidentally unwinding and releasing the jaws. The reel is unwound to release the jaws.

U.S. Pat. No. 4,469,195 of Sartain shows a ladder attachment including a pair or rotatable jaws or horns which are normally biased closed by a spring, which is interconnected between the horns. Extensions of the horns force the horns apart when pressed against a tree. The ladder is released and lowered by a pull rope, which is attached at one end to the horns and extends to the bottom of the ladder to be pulled by an operator.

Each of the above described ladders has certain defects, which affect the ease of erecting a ladder and the possible accidental release of the upper portion of the ladder from the pole or the like. Each of the German and Sartain patents has arms, which are spring biased to an open position to receive the pole. To close their arms and thus secure the ladder to the pole, it is necessary while balancing the ladder in its upright position to pull at the same time a cord or rope attached to those arms, thus bringing their arms together about the pole and securing the upper portion of the ladder to the pole. The Henson ladder has the advantage of permitting it to be easily erected by engaging his arms with the pole, thus moving the arms to a closed, holding position about the pole. However, both the Henson and Sartain ladders may be accidentally released from their poles. Only a spring serves to hold their arms together about their poles; a sudden motion by a person at the ladder top could readily overcome the retaining action of the springs on their arms and accidentally release the ladder from the pole. The German patent uses a detente to prevent its reel from being unwound and the arms released. However, that detente could be accidentally kicked or otherwise accidentally dislodged from the reel, while a person is at the top of the ladder.

SUMMARY OF THE INVENTION

It is therefore an object of this invention to provide a new and improved stabilizing device for use with a ladder, which permits the ladder to be readily secured to a pole or the like and prevents the ladder from being accidentally released from the pole.

It is another object of this invention to provide a new and improved stabilizing device with a latch for preventing a ladder from being released from a pole or the like, which permits a person at the foot of the ladder to release the latch and at the top of the ladder to prevent the latch from being released from the pole.

In accordance with these and other objects of this invention, there is described a ladder and platform assembly. The ladder is attached at one end to the platform and includes a pair of generally parallel, spaced apart legs and a plurality of steps disposed between and interconnected between the legs. The platform includes a latch assembly for stabilizing the platform when the platform is disposed to rest against a utility pole or the like, which has a given configuration. The platform has an opening of a configuration similar to the given configuration for receiving and releasing the pole. The latch assembly includes latch pivotally mounted on the platform to move between a first, closed position wherein the latch retains the pole within the opening and a second, closed position wherein the latch permits the pole to be received within or removed from the opening. The latch has an extended portion. A spring is attached to the latch for normally biasing the latch to the second, open position. A self locking detent is disposed for engaging the extended portion of the latch as it moves to the second, closed position and retaining the latch in a locked relationship therewith in the second, closed position. An actuable mechanism is provided for releasing the detente from the locked relationship with the latch and permitting the latch to return to first, open position under the influence or the biasing spring.

In a further aspect of this invention, the releasing mechanism comprises a cord having a first end attached to the detente and the other falling downwardly to be grasped and pulled, whereby said detente is released from its locked relationship with the latch. A second detente is provided for engaging and retaining the latch in its locked relationship therewith in the second, closed position regardless of whether the releasing the mechanism is actuated. In an illustrative embodiment of this invention, the second detente takes the form of a latch pin, which is inserted into an opening in each of the platform and the latch. The latch pin is removably inserted into these openings to thereby retain the latch in its first, closed position.

In a further aspect of this invention, the platform includes a mechanism for releasably receiving and securely attaching the ladder to the platform whereby the ladder and platform may be disassembled for transport.

BRIEF DESCRIPTION OF THE DRAWINGS

A written description setting forth the best mode presently contemplated for carrying out the present invention and of the manner for implementing and using it, is provided by the following detailed description of an illustrative embodiment of this invention in one or more of the following drawings:

FIG. 1 is a perspective view of the ladder and platform assembly in accordance with the teachings of this invention with a stabilizing device for permitting the easy erection and securing of the upper portions of the ladder to a utility pole, tree or the like;

FIG. 2 is plan view taken from the top of the platform shown in FIG. 1, particularly illustrating the relationship between the latch for releasably securing the assembly to the pole and a detente for preventing the accidental release of the latch;

FIG. 3 is a side view of the ladder and platform assembly as shown in FIG. 1 particularly showing how the ladder may be releasably secured to the platform for easier carrying to a given site.

DESCRIPTION OF A PREFERRED EMBODIMENT OF THE INVENTION

Figure 1:
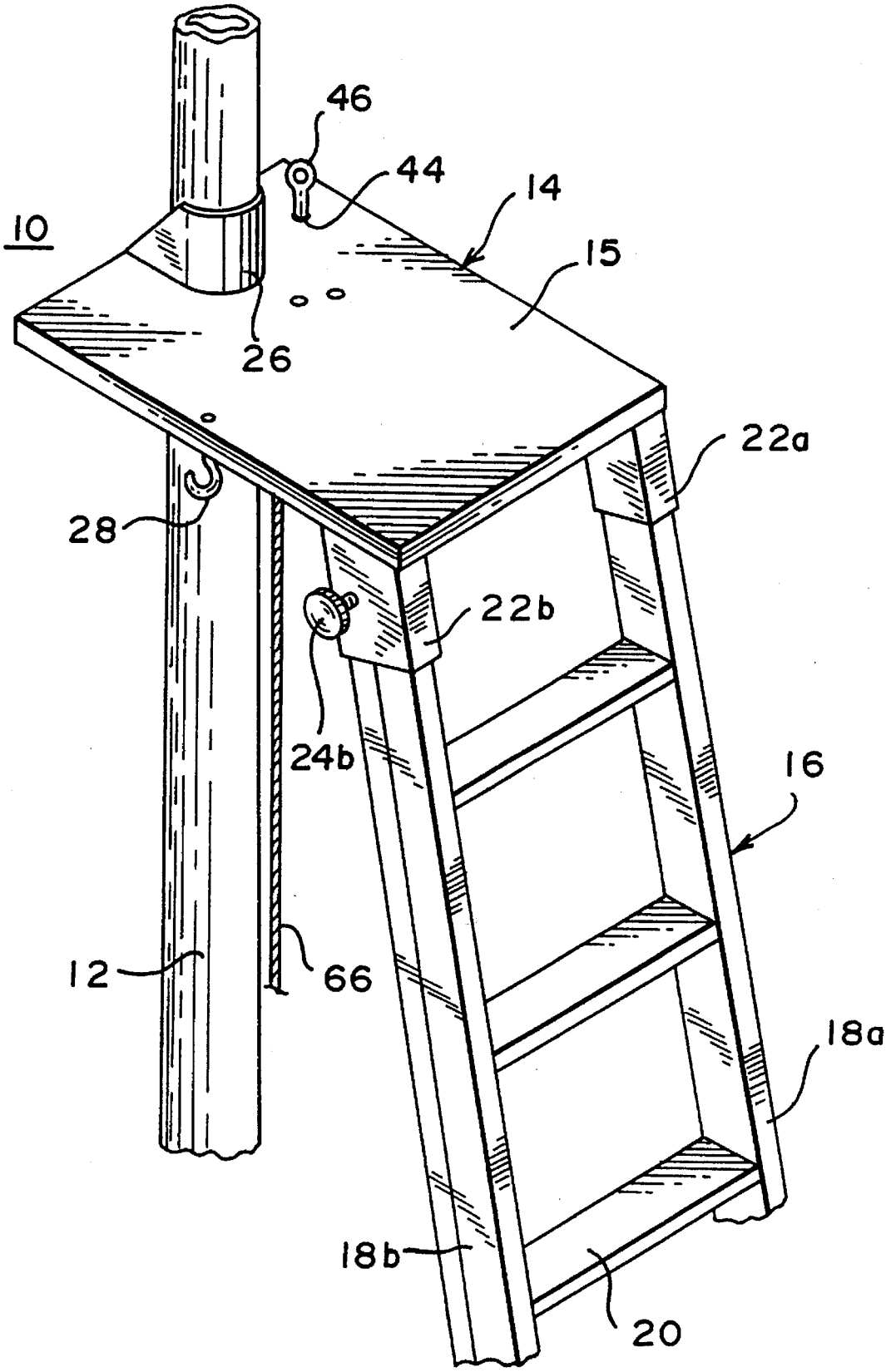

Referring now to the drawings and in particular to FIG. 1, there is shown a ladder and platform assembly 10 in accordance with the teachings of this invention. The assembly 10 includes a platform 14, which is adapted as will be described below to be releasable attached to a utility pole 12, tree or the like. The platform 14 is adapted to be releasably connected to a ladder 16, which comprises a pair of upright legs 18*a* and *b* and a plurality of steps 20 connected therebetween. The platform 14 and the ladder 16 are disconnected for easy transport to the pole 12 and then connected before the assembly 10 thereof is attached in turn to the pole 12. As shown in FIG. 3, each of the legs 18*a* and *b* fits within a corresponding one of the pair of support channels 22*a* and *b*, which are of a rectangular configuration similar to that of a cross-section of the legs 18*a* and *b* and are affixed to the platform 14 adjacent a back edge 21 thereof. The channels 22*a* and *b* threadably receive corresponding fastening knobs 24*a* and *b*. After a leg 18 is inserted into its channel support 22, the knob 24 is rotated to increasingly engage the inserted leg 18 and thereby secure it to the channel 22. The platform 14 and the support channels 22 are made of a sturdy, light weight material, e.g., aluminum. The ladder 16 is also constructed of a sturdy, light weight material, e.g., fiberglass.

As shown in FIG. 2, a latch 30 is pivotally mounted on the platform 14 to rotate about a latch pivot 32 between a first, open position shown in dot-dash line and a second, closed position shown in full and dotted line. The latch 30 comprises a receiving arcuate portion 34 and a closing arcuate portion 35, both of which have a curved or arcuate configuration similar to that of the pole 12, a portion 36 extending from the arcuate portion 34 and a lever portion 38, which is attached to the latch 30 at its latch pivot 32. The lever portion 38 has a first opening 42 for receiving a first end of a coil tension spring 46, which has a second end secured to an opening 43 within the platform 14. The spring 46 biases the latch 30 to rotate in a clockwise direction as shown in FIG. 2 towards in its first, open position. Further, the platform 14 has an opening 25 disposed into a front edge 23 thereof and having a rounded configuration similar to that of the pole 12 for readily receiving the pole 12. A support collar 26 of a configuration similar to that of the opening 25 and the pole 12 is attached to the platform 14 in alignment with the opening 25 to increase the support surface in contact with the pole 12 and thereby stabilize the assembly 10.

After the ladder 16 has been connected to the platform 14, the assembly 10 thereof is raised and the platform 14 is guided by the user so that the pole 12 is disposed within the opening 25. As the pole 12 slides into the opening 25, it engages the receiving arcuate portion 34 and rotates the latch 30 counter clockwise from its first, open position as shown in full and dot line to its second, closed position as shown in dot-dashed line. In its closed position, the closing arcuate portion 35 of the latch 30 retains or locks the pole 12 in the opening 25 as will be explained. In particular, the extended portion 36 of the latch 30 engages as it rotates in the counter clockwise direction a self locking detente 50, whereby the latch 30 is securely held in its second closed position until the detente 50 is released.

Figure 4:
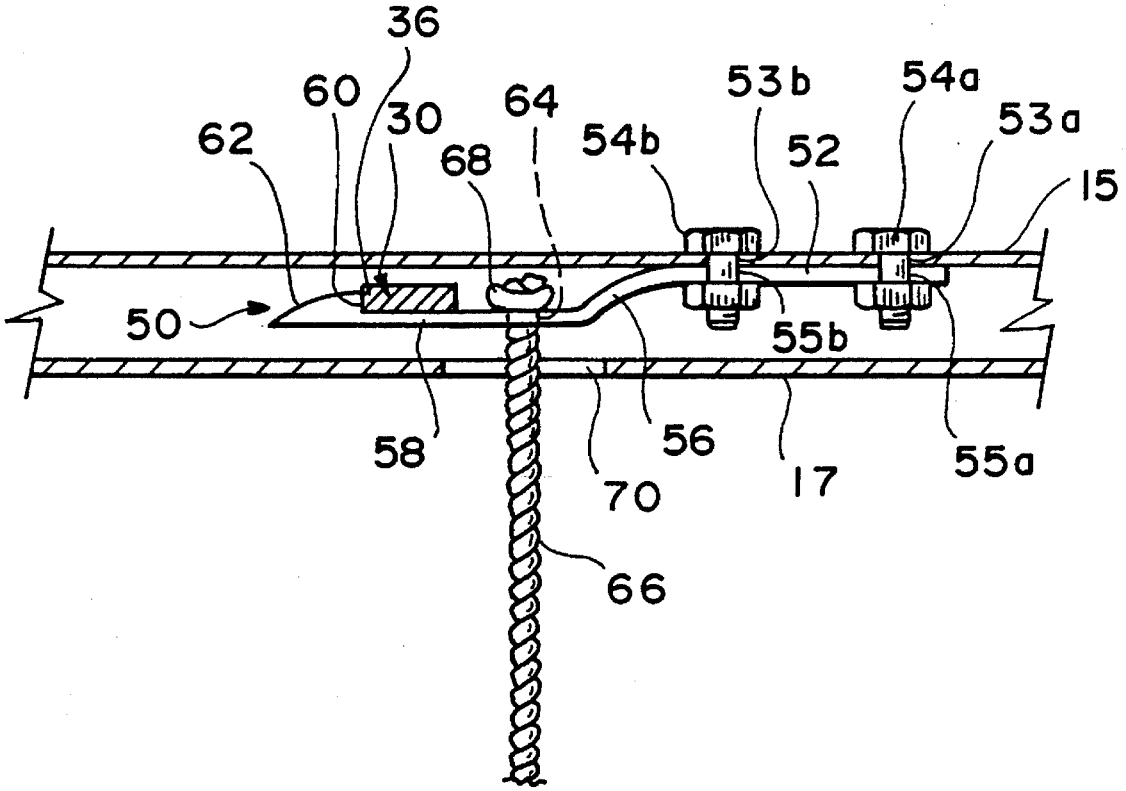
FIG. 4 is sectioned view of the self-locking detente taken along line 4—4 of FIG. 2.

As more fully shown in FIG. 4, the detente 50 includes a relatively flat portion 42, an offset portion 64, a cantilever portion 58, a catch 60 and a curved cam portion 62. The platform 14 includes a top plate 15 and a bottom plate 17. The detente 50 is disposed between the plates 15 and 17, and is affixed to the bottom surface of the plate 15. In particular, a pair of nuts and bolts 54*a* and *b* are inserted respectively through plate openings 53*a* and *b*, and openings 55*a* and *b* of the attached portion 52 to thereby secure the detente 50 to the platform 14. In operation, the extended portion 36 of the latch 30 moves to the right as shown in FIG. 4, as the pole 12 is inserted into the opening 25, whereby the extended portion 36 engages the cam portion 62 of the detente 50 and thus depresses the latch 30 downwardly against the spring action of the cantilever portion 58. The extended portion 36 continues to move to the right until the cantilever portion 58 springs back, upwardly and the portion 36 is retained by the catch 60, thus locking the latch 30 in its second, closed position, until released as will be explained.

As shown in FIGS. 1 and 4, one end of a latch release rope 66 is inserted through an opening 64 within the cantilever portion 58 and tied in a knot 68. The other end of the rope 66 falls downwardly through an opening 70 within the bottom plate 17 to be grasped and pulled downward, whereby the catch 60 releases the extended portion 36 from the detente 50 and the latch 30 is rotated by the biasing spring 46 from its second, closed position to its first, open position. When the latch 50 is in its open position, the assembly 10 may be removed from the pole 12.

As shown in FIGS. 1 and 2, a latch safety pin 46 provides an extra measure of protection against the accidental release of the latch 30. After the latch 30 is disposed to its second, closed position, the pin 46 is inserted through an opening 44 through the top plate 15 of the platform 14, an opening 42 through the lever portion 42 of the latch 30 and an opening (not shown) through the bottom plate 17 and aligned with the opening 42. In operation, a user aligns the opening 25 with the pole 12 and pushes the assembly 10 so that the pole 12 engages and rotates the latch 30 until its extended portion 36 is retained by the catch 60 of the detente 50. After climbing the ladder 16, the user inserts the pin 46 through the openings 44 and 42, whereby the latch 30 is double locked in its second, closed position. Thus even if the rope 66 is pulled and the detente 50 is pulled downward to normally release the latch 30, the latch 30 is still retained in its second, closed position by the pin 46. Only the user who has climbed to the top of the ladder 16 and inserted the pin 46, can withdraw the pin 46 thus providing an extra measure of security to the user.

The assembly 10 described above allows a single serviceman to safely and quickly attend and repair free-standing area lighting lamps used with underground service and that are inaccessible with a bucket truck. When service is required, the ladder 16 is used to gain access to the lamp at the top of the 12 to 15 foot high and 3 to 4 inch diameter lamp post, for example. The platform 14, which is easily attached by the hand operated fastening knobs 24 to the ladder 16, provides a convenient work surface for tools and lamp parts, while also providing ladder stability. A lone serviceman, using this assembly 10, can safely and quickly perform the needed lamp service. The assembly 10 eliminates the need for the additional crew and makes the job safer. The stabilizing assembly 10 securely attaches the platform 14 to the lamp post 12 with the latch 30 that is engaged by simply leaning the ladder 16, with platform 14 attached, against the lamp post 12, and pushing it to engage the latch 30. The assembly 10 is also easily detached from the lamp post 12 by pushing the ladder 16 away from the lamp post 16 while pulling the latch release rope 66. As an additional safety feature, the safety pin 46 is inserted into the latch 30 after it is engaged on the lamp post 16, thereby preventing inadvertent latch release.

In considering this invention, it should be remembered that the present invention is illustrative and the scope of the invention should be determined by the appended claims.

I claim:

1. The assembly of a ladder and a platform comprising:

a) said ladder comprising a pair of generally parallel, spaced apart legs and a plurality of steps disposed between and interconnected between said legs;

b) said platform having means for stabilizing a utility pole or the like with respect to said platform, the utility pole having a given configuration;

c) said stabilizing means comprising means for defining an opening of a configuration similar to said given configuration for receiving therein and releasing therefrom the pole, means for releasably receiving and securely attaching said ladder to said platform, latch means disposable between a first, closed position for retaining the pole in said opening and a second, open position for receiving and releasing the pole, said latch comprising a first portion oriented when said latch is disposed in said first, closed position to retain the pole in said opening and a second portion oriented when said latch is disposed in said second, open position to be engaged by the pole to move said latch from said second, open position to said first, closed position, and means for biasing said latch means to said second, open position, wherein said stabilizing means further comprises a self locking detente for engaging said latch means as it is disposed to said second, closed position and retaining said latch means in a locked relationship therewith in said second, closed position, and actuable means for releasing said detente from said locked relationship with said latch means and permitting said latch means to return to said first, open position under the influence of said biasing means.

2. The assembly as claimed in claim 1, wherein said latch comprises a base rotably mounted with respect to said platform and said first and second portions extending from said base in a Y-shaped configuration.

3. A ladder comprising a pair of generally parallel, spaced apart legs and a plurality of steps disposed between and interconnected between said legs, an upper portion and means for stabilizing said upper portion of said ladder when said upper portion is disposed to rest against a utility pole or the like, the utility pole having a given configuration, said stabilizing means comprising:

a) means for defining an opening of a configuration similar to said given configuration for receiving the pole;

b) a latch mounted to move between a first, closed position wherein said latch retains the pole within said opening and a second, open position wherein said latch permits the pole to be received within or removed from said opening, said latch having an extended portion;

c) means for normally biasing said latch to said second, open position;

d) a self locking detente for engaging said latch as it moves to said first, closed position and retaining said latch in a locked relationship therewith in said first, closed position;

e) actuable means for releasing said detents from said locked relationship with said latch and permitting said latch to return to said second, open position under the influence of said biasing means, said releasing means comprises a cord having a first end attached to said detents and the other falling downwardly to be grasped and pulled, whereby said detents is released from said locking position; and f) a second detents for engaging and retaining said latch in said locked relationship therewith in said first, closed position regardless of whether said releasing means is actuated.

4. The ladder as claimed in claim 3, wherein there is included a platform and means for attaching said ladder to said platform, said platform comprising said opening defining means, said latch being pivotally mounted on said platform.

5. The ladder as claimed in claim 4, wherein said detente is affixed to said platform and comprises a catch and a flexible cantilever portion for movement between a first position wherein said catch engages and retains said latch in said locked relationship and a second position wherein said detente is free of said latch.

6. The ladder as claimed in claim 5, wherein said releasing means comprises a cord having a first end connected to said cantilever portion and a second end falling downwardly therefrom to be grasped and pulled downwardly to dispose said cantilever to its second position.

7. The ladder as claimed in claim 6, wherein there is included a latch pin and each of said platform and said latch has at least one hole therein, said latch pin being removably inserted into said one hole to thereby retain said latch in said first, closed position regardless of whether said releasing means is actuated.

8. A pole latch assembly in combination with a ladder for stabilizing said ladder when said ladder is disposed to rest against a utility pole or the like, the utility pole having a given configuration, said ladder comprising a pair of generally parallel, spaced apart legs and a plurality of steps disposed between and interconnected between said legs, said pole latch assembly comprising:

a) means for defining an opening of a configuration similar to said given configuration for receiving the pole;

b) a latch mounted to move between a first, closed position wherein said latch retains the pole within said opening and a second, open position wherein said latch permits the pole to be received within or removed from said opening, said latch having an extended portion;

c) means for normally biasing said latch to said second, open position;

d) a releasable, self locking detent for engaging said latch only when it moves to said first, closed position and retaining said latch in a locked relationship therewith in said first, closed position; and e) actuable means for releasing said releasable detents from said locked relationship with said latch and thereby permitting said latch to return to said second, open position under the influence of said biasing means.

9. The assembly as claimed in claim 8, wherein said releasing means comprises a cord having a first end attached to said detente and the other falling downwardly to be grasped and pulled, whereby said detente is released from said locked relationship.

10. The assembly as claimed in claim 9, wherein there is further included a second detente for engaging and retaining said latch in said locked relationship therewith in said first, closed position regardless of whether said releasing means is actuated.

11. A ladder comprising a pair of generally parallel, spaced apart legs and a plurality of steps disposed between and interconnected between said legs, an upper portion and means for stabilizing said upper portion of said ladder when said upper portion is disposed to rest against a utility pole or the like, the utility pole having a given configuration, said stabilizing means comprising:

a) means for defining an opening of a configuration similar to said given configuration for receiving the pole;

b) a latch mounted to move between a first, closed position wherein said latch retains the pole within said opening and a second, open position wherein said latch permits the pole to be received within or removed from said opening, said latch having an extended portion;

c) means for normally biasing said latch to said second, open position;

d) a releasable, self locking detente for engaging said latch only when it moves to said first, closed position and retaining said latch in a locked relationship therewith in said first, closed position; and e) actuable means for releasing said releasable detents from said locked relationship with said latch and thereby permitting said latch to return to said second, open position under the influence of said biasing means, wherein said latch comprising a portion oriented when said latch is disposed in said second, open position to be engaged by the pole to move said latch from said second, open position to said first, closed position.

* * * * *